US009523135B2

(12) United States Patent
Mimura et al.

(10) Patent No.: US 9,523,135 B2
(45) Date of Patent: Dec. 20, 2016

(54) METHOD OF COLD-ROLLING STEEL SHEET AND COLD-ROLLING FACILITY

(71) Applicant: NIPPON STEEL & SUMITOMO METAL CORPORATION, Tokyo (JP)

(72) Inventors: Hiroyuki Mimura, Tokyo (JP); Takao Mukai, Tokyo (JP); Kazuhiro Miyamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 66 days.

(21) Appl. No.: 14/577,558

(22) Filed: Dec. 19, 2014

(65) Prior Publication Data

US 2015/0101383 A1 Apr. 16, 2015

Related U.S. Application Data

(62) Division of application No. 12/811,161, filed as application No. PCT/JP2009/052232 on Feb. 10, 2009, now Pat. No. 8,943,868.

(30) Foreign Application Priority Data

Feb. 13, 2008 (JP) ..... 2008-032095

(51) Int. Cl.
*B21B 1/36* (2006.01)
*C21D 8/12* (2006.01)
(Continued)

(52) U.S. Cl.
CPC ..... *C21D 8/1233* (2013.01); *B21B 1/222* (2013.01); *B21B 1/36* (2013.01); *B21B 45/004* (2013.01);
(Continued)

(58) Field of Classification Search
CPC ..... B21B 2001/221; B21B 1/222; B21B 1/24; B21B 1/28; B21B 1/32; B21B 1/36; B21B 45/004; C21D 8/1233
See application file for complete search history.

(56) References Cited

U.S. PATENT DOCUMENTS 2,067,192 A 1/1937 Hudson
2,067,514 A * 1/1937 Trinks ..... B21B 45/02 29/17.2
(Continued)

FOREIGN PATENT DOCUMENTS

JP 54-13846 B2 6/1979
JP 61-132205 A 6/1986
(Continued)

OTHER PUBLICATIONS

Chinese Office Action dated Jun. 4, 2012 issued in corresponding Chinese Patent Application No. 200980105114.X (English summary is attached).
(Continued)

*Primary Examiner* — Edward Tolan
(74) *Attorney, Agent, or Firm* — Birch, Stewart, Kolasch & Birch, LLP

(57) ABSTRACT

In cold-rolling a steel sheet coil, when a tail end portion of a steel sheet coil (7) is wound around a tension reel (3) prior to second-pass rolling after the completion of first-pass rolling, the tail end portion is heated to a temperature within a range of not lower than 50° C. nor higher 350° C. with a heater disposed between a rolling stand (1) and the coil tail end-side tension reel (3).

8 Claims, 5 Drawing Sheets

(51) Int. Cl.

| | |
|---|---|
| ***B21B 45/00*** | (2006.01) |
| ***B21C 47/26*** | (2006.01) |
| ***B21B 1/22*** | (2006.01) |
| ***H01F 1/147*** | (2006.01) |
| *B21B 13/14* | (2006.01) |

(52) U.S. Cl.
CPC ..... *B21C 47/26* (2013.01); *H01F 1/14775* (2013.01); *B21B 13/147* (2013.01)

(56) References Cited

U.S. PATENT DOCUMENTS

| | | | | |
|---|---|---|---|---|
| 2,867,557 | A * | 1/1959 | Crede | C21D 8/1222 148/111 |
| 3,201,297 | A * | 8/1965 | Canfor | B21C 47/02 156/162 |
| 3,928,999 | A | 12/1975 | Anderson et al. | |
| 3,933,024 | A | 1/1976 | Matsumoto et al. | |
| 4,563,226 | A * | 1/1986 | Matsuo | C21D 8/1227 148/111 |
| 4,906,809 | A | 3/1990 | Workman | |
| 5,350,010 | A | 9/1994 | Sawada et al. | |
| 5,479,807 | A | 1/1996 | Moser | |
| 5,666,842 | A * | 9/1997 | Komatsubara | C21D 8/1227 72/200 |
| 5,755,128 | A | 5/1998 | Tippins et al. | |
| 5,771,732 | A | 6/1998 | Kramer et al. | |
| 5,823,037 | A | 10/1998 | Kim et al. | |
| 6,237,205 | B1 * | 5/2001 | Yoshimura | B21B 1/36 29/33 Q |
| 6,282,938 | B1 | 9/2001 | Mertens et al. | |
| 7,028,522 | B2 | 4/2006 | Kim et al. | |

FOREIGN PATENT DOCUMENTS

| | | | |
|---|---|---|---|
| JP | 61-135407 | A | 6/1986 |
| JP | 7-60303 | A | 3/1995 |
| JP | 10-85802 | A | 4/1998 |

OTHER PUBLICATIONS

International Search Report, dated Mar. 31, 2009, issued with PCT/JP2009/052232.

U.S. Office Action dated Feb. 7, 2013, for U.S. Appl. No. 12/811,161.

U.S. Office Action dated Jul. 16, 2013, for U.S. Appl. No. 12/811,161.

U.S. Office Action dated May 21, 2014, for U.S. Appl. No. 12/811,161.

* cited by examiner

METHOD OF COLD-ROLLING STEEL SHEET AND COLD-ROLLING FACILITY

This application is a Divisional of U.S. application Ser. No. 12/811,161 filed on Jun. 29, 2010, which is a continuation application of PCT/JP2009/052232 filed on Feb. 10, 2009 which claims priority from Japanese Patent Application No. 2008-032095, filed on Feb. 13, 2008. The entirety of each of the above-mentioned patent applications is hereby expressly incorporated by reference herein and made a part of this specification.

TECHNICAL FIELD

The present invention relates to a cold-rolling method and a cold-rolling facility suitable for rolling a brittle steel sheet such as a grain-oriented electromagnetic steel sheet having a high Si content.

BACKGROUND ART

Conventionally, in manufacturing a grain-oriented electromagnetic steel sheet having a high magnetic flux density and excellent in iron loss, a steel sheet is subjected to processing where it is kept at a temperature within a 50° C. to 350° C. range for one minute or more between passes of cold-rolling. Such processing is called inter-pass aging and is described in a patent document 1.

Rolling using a tandem mill has a difficulty in yielding an effect equivalent to that of the inter-pass aging. Therefore, in manufacturing a grain-oriented electromagnetic steel sheet excellent in orientation and high in magnetic flux density, cold-rolling using a reverse rolling mill is generally performed. This is because it is easy to keep the temperature between passes.

A grain-oriented electromagnetic steel sheet high in magnetic flux density contains 3% silicon or more for realizing a brittle. Therefore, low iron loss and is very an edge crack is likely to occur during the manufacture. Further, the edge crack, even if only a small, sometimes becomes larger to cause a sheet fracture. Especially in rolling using a single-stand reverse rolling mill, since the structure of a rolling mill necessitates a work of winding an end portion of a hot-rolled coil around a tension reel, it is highly possible that the steel sheet finally fractures due to a bending stress generated when the coil end portion is wound around the tension reel.

Here, cold-rolling using a single-stand reverse rolling mill will be described. FIG. 4A to FIG. 4E are views showing a cold-rolling method using a single-stand reverse rolling mill in order of processes.

In a cold-rolling facility using a single-stand reverse rolling mill, a rolling stand (reverse rolling mill) 21 is disposed at the center. Further, across the rolling stand 21, a coil leading end-side tension reel 22 is disposed on one side, and a coil tail end-side tension reel 23 and a pay-off reel 24 are disposed on the other side.

Prior to the cold-rolling, a steel sheet coil (hot-rolled coil) 25, which is made by coiling a steel sheet 26 being a target of rolling, is carried to the pay-off reel 24, as illustrated in FIG. 4A. Next, a leading end of the steel sheet 26 is drawn out from the steel sheet coil 25 to be wound around the tension reel 22 via the rolling stand 21.

Thereafter, as illustrated in FIG. 4B, the steel sheet 26 is rolled in a first pass while being given a tension between the pay-off reel 24 and the tension reel 22. Then, as illustrated in FIG. 4C, when a tail end 27 of the steel sheet coil 25 is apart from the pay-off reel 24, the rolling is finished, and as illustrated in FIG. 4D, the tail end 27 is wound around the coil tail end-side tension reel 23 located between the pay-off reel 24 and the rolling stand 21. Thereafter, as illustrated in FIG. 4E, the steel sheet 26 is rolled in second and subsequent passes while being given a tension between the both tension reels 22 and 23.

In the cold-rolling by this method, an unrolled portion 28 is left in the tail end 27 after the first-pass rolling, as illustrated in FIG. 5. Therefore, when the tail end 27 is wound around the tension reel 23, a portion with a certain length of a first-pass rolled portion 30 is wound after the unrolled portion 28 is wound. At this time, a high-curvature portion that is first wound sometimes fractures.

Further, as a result of the first-pass rolling, there is formed a roll bite portion (first-pass roll bite portion) 29, whose thickness changes from t0 obtained after the hot rolling to a thickness t1 obtained after the first-pass rolling. The roll bite portion 29 is also a boundary region between the unrolled portion 28, which has a large thickness and a large bending stress, and the first-pass rolled portion 30, which has undergone work hardening. Therefore, the roll bite portion 29 sometimes suffers fracture when it is wound.

Therefore, from a viewpoint of productivity improvement, it is important to alleviate brittleness of a material to prevent the occurrence of sheet fracture. Such sheet fracture sometimes occurs not only in a grain-oriented electromagnetic steel sheet having a high Si content but also when other brittle steel sheet (for example, a steel sheet of high-carbon steel) is rolled in the above-described manner.

A patent document 2 describes an art to alleviate brittleness of a material when a brittle steel sheet such as an electromagnetic steel sheet is cold-rolled. In this art, at the time of the cold-rolling using a continuous tandem rolling mill, by setting a strip temperature to 50° C. to 150° C. in advance, a steel sheet is heated before carried to a first rolling stand, so that, between rolling stands, the steel sheet is kept at a temperature within a predetermined range.

However, applying this art to a reverse rolling mill gives rise to the following problems.

(i) In the rolling using the reverse rolling mill, since a tail end is wound around a tension roll after first-pass rolling is completed, the effect of heating a steel sheet, even if performed beforehand, is weakened before the winding.

(ii) Since the rolling is stopped at the first roll bite portion in spite that this portion is a portion most likely to fracture, it is not possible to obtain sufficient deformation heating.

(iii) After being exposed to rolling oil, the first-pass roll bite portion is exposed to the outside air until it is wound around the tension reel and thus is rapidly deprived of heat when the rolling oil vaporizes.

(iv) In rolling the grain-oriented electromagnetic sheet, if a coil before being cold-rolled is heated to a temperature that is increased in consideration of an amount of the deprived heat, the temperature becomes too high, so that a magnetic characteristic of a finally obtained steel sheet deteriorates.

Therefore, even applying the art of the patent document 2 to the reverse rolling mill cannot produce a sufficient effect of alleviating brittleness when the tail end of the steel sheet is wound around the coil tail end-side tension reel.

Further, a patent document 3 describes an art to prevent a decrease in temperature of a steel sheet by covering an area between a pay-off reel and a rolling stand by a heat-insulating enclosure wall. It is conceivable to solve the problem (iii) of the patent document 2 by using this art.

In this case, however, the heat-insulating enclosure wall needs to cover a range up to an area close to the rolling stand. In the reverse rolling mill, the tail end side changes to a leading side in even-numbered passes. Therefore, a large volume of accompanying fume enters the inside of the enclosure wall and the fume is filled inside the enclosure wall, which makes it difficult to ensure measurement precision of instrumentation devices (a sheet-thickness gauge, a sheet-temperature gauge, and the like) inside the enclosure wall and to ensure the maintenance of a facility.

Further, increasing a reel diameter in order to reduce the bending stress itself could reduce the occurrence of the sheet fracture, but applying the increase in the reel diameter to existing devices is difficult because of space. Further, an unrolled portion becomes longer by the increased size, which lowers yields.

Patent document 1: Japanese Examined Patent Publication No. Sho 54-13846

Patent document 2: Japanese Patent Application Laid-open No. Sho 61-132205

Patent document 3: Japanese Patent Application Laid-open No. Sho 61-135407

SUMMARY OF THE INVENTION

It is an object of the present invention to provide a steel sheet cold-rolling method and a cold-rolling facility capable of suppressing the occurrence of sheet fracture when a brittle steel sheet such as a grain-oriented electromagnetic steel sheet having a high Si content, is cold-rolled by using a reverse rolling mill.

To solve the above problem, the present invention includes the following structure.

(1) A method of cold-rolling a steel sheet coil with using a pay-off reel and a single-stand reverse rolling mill, including:

rolling the steel sheet coil in a first pass with using the reverse rolling mill;

after the rolling, heating a tail end portion of the steel sheet coil to a temperature within a range of not lower than 50° C. nor higher than 350° C. with a heater disposed between the reverse rolling mill and a coil tail end-side tension reel, and winding the tail end portion around the coil tail-end side tension reel; and after the heating, rolling the steel sheet coil in second and subsequent passes.

(2) The method of cold-rolling a steel sheet coil described in (1), wherein the tail end portion is heated with the heater while approaching the coil tail-end side tension reel.

(3) The method of cold-rolling a steel sheet coil described in (1), wherein the tail end portion includes an unrolled portion left unrolled after the rolling in the first pass and a roll bite portion adjacent to the unrolled portion.

(4) The method of cold-rolling a steel sheet coil described in (2), wherein the tail end portion includes an unrolled portion left unrolled after the rolling in the first pass and a roll bite portion adjacent to the unrolled portion.

(5) The method of cold-rolling a steel sheet coil described in (1), wherein the steel sheet coil is a hot-rolled coil for a grain-oriented electromagnetic steel sheet containing 3 mass % Si or more, and the tail end portion is heated with the heater to a temperature range within a 50° C. to 150° C. range.

(6) The method of cold-rolling a steel sheet coil described in (2), wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

(7) The method of cold-rolling a steel sheet coil described in (3), wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

(8) The method of cold-rolling a steel sheet coil described in (4), wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

(9) A cold-rolling facility including:

a pay-off reel;

a single-stand reverse rolling mill;

a coil tail end-side tension reel; and a heater disposed between the reverse rolling mill and the coil tail end-side tension reel, and heating a tail end portion of a steel sheet coil.

(10) The cold-rolling facility described in (9), wherein the heater has a header unit jetting steam from a plurality of nozzles.

(11) The cold-rolling facility described in (9), wherein the heater is an electric heater.

(12) The cold-rolling facility described in (9) including a coil end guide disposed between the reverse rolling mill and the coil tail end-side tension reel and including the heater.

(13) The cold-rolling facility described in (10), including a coil end guide disposed between the reverse rolling mill and the coil tail end-side tension reel and including the heater.

(14) The cold-rolling facility described in (11), including a coil end guide disposed between the reverse rolling mill and the coil tail end-side tension reel and including the heater.

DETAILED DESCRIPTION OF THE PREFERRED EMBODIMENTS

Figure 1:
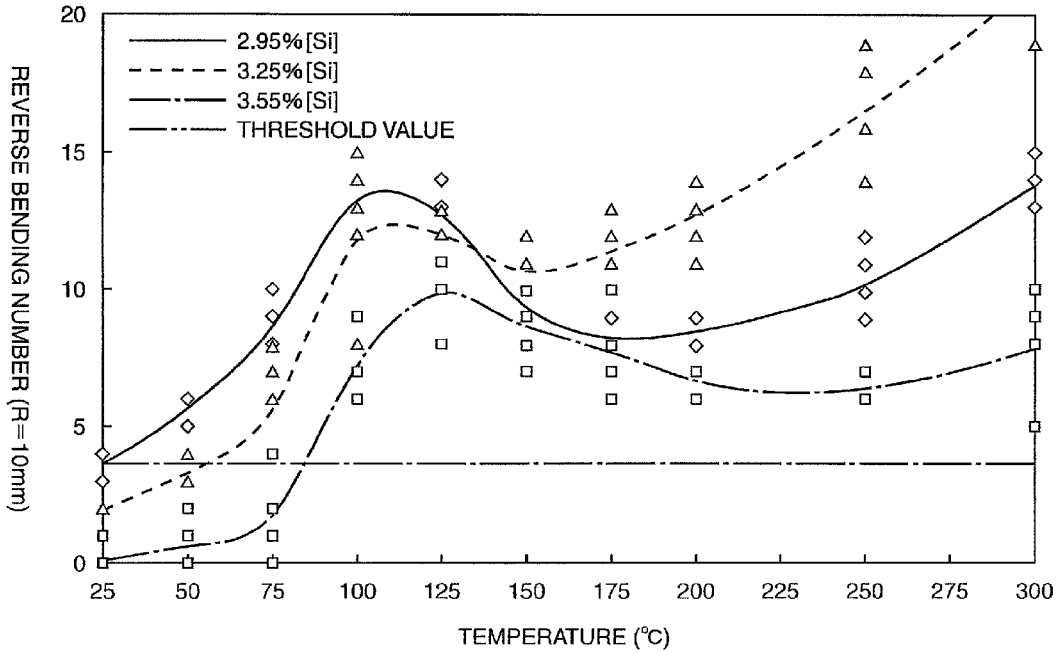
FIG. 1 is a chart showing reverse bending numbers of grain-oriented electromagnetic steel sheets at various temperatures from room temperature to 300° C.

Hereinafter, an embodiment of the present invention will be described in detail with reference to FIG. 1 to FIG. 3.

In reverse rolling, a portion near a first-pass roll bite most likely to suffer sheet fracture is a portion where sufficient deformation heating cannot be obtained. Further, after exposed to rolling oil during the first-pass rolling, the portion near the first-pass roll bite is exposed to the outside air until it is wound around a tension reel, and thus is cooled and is deprived of heat rapidly in accordance with the vaporization of the rolling oil. For this reason, even if the portion is heated to a predetermined temperature beforehand, it is extremely difficult to ensure its sheet temperature.

Therefore, it is thought to be effective to reheat a tail end portion of the coil having subjected to the first-pass rolling immediately before the coil tail end portion is wound around a coil tail end-side tension reel.

Therefore, the inventors of the present application studied a temperature necessary for ensuring that even a brittle steel sheet does not suffer fracture when the tail end portion is wound around the tension reel.

It has been known that a grain-oriented Electromagnetic steel sheet can be wound around the tension reel without any problem of fracture if its Si content is less than 3%. Therefore, hot-rolled steel sheets for grain-oriented electromagnetic steel sheets having different Si contents, namely 2.95 mass % 3.25 mass %, and 3.55 mass %, were fabricated, and the reverse bending numbers at various temperatures from room temperature to 300° C. were examined. The result is illustrated in FIG. 1.

Since the fracture does not occur in the steel sheet whose Si content is less than 3 mass % as described above, it can be said that the fracture does not occur if bendability equivalent to that of a steel sheet whose Si content is 2.95 mass % is ensured. As illustrated in FIG. 1, in the steel sheet whose Si content is 2.95 mass %, the reverse bending number at room temperature (25° C.) was four. Therefore, with this number (four) being defined as a Reference (threshold value), it is seen that, in order to obtain the reverse bending number substantially equal to the reference, the steel sheet needs to be heated to a temperature at least equal to or higher than 50° C. and is preferably heated to a temperature equal to or higher than 90° C.

From this result, it has been found out that heating the coil tail end portion to the temperature equal to sot or higher makes it possible to wind the steel sheet coil for a grain-oriented electromagnetic steel sheet containing 3 mass % Si or more around the tension reel without causing any fracture.

Incidentally, if the heating temperature is too high, there sometimes occurs a problem regarding a facility and a material of the steel sheet, which is not economically preferable, and therefore, the heating temperature is preferably set to 150° C. or lower. Further, since even heating to a temperature equal to 150° C. or higher yields a small effect of improving bendability, as illustrated in FIG. 1, an upper limit of the heating temperature for the steel sheet for a grain-oriented electromagnetic steel sheet is preferably 150° C.

Further, in reverse rolling of other brittle steel sheets (for example, a high carbon steel), as in reverse rolling of the grain-oriented electromagnetic steel sheet, heating a coil tail end portion makes it possible to wind the steel sheet around the tension reel without causing any fracture. The heating temperature in this event may be decided according to a material of the steel sheet as in the case of the grain-oriented electromagnetic steel sheet, but is preferably decided to a temperature within a range of 350° C. or lower because of the same reason as that in the case of the grain-oriented electromagnetic steel sheet.

A heated range of the steel sheet includes at least a region from the coil tail end portion to the roll bite portion adjacent to the unrolled portion. More desirably, the range includes part of the first-pass rolled portion. The coil tail end portion may be heated either from an upper surface or from a lower surface of the coil. It may be heated from both surfaces but heating from one surface side is sufficient.

Even when such heating is performed, the heated range is only the unrolled portion discarded as an off gauge and part of the first-rolled portion. Therefore, the heating at this temperature range does not have any influence on a characteristic of a finally obtained steel sheet, that is, a steel sheet product.

Since the heating temperature range is 350° C. or lower, various apparatus are usable as the heater, but heating with steam is suitable, because precise temperature control is not necessary and the heating with steam can simplify the facility.

In a cold-rolling facility, such a heater is disposed between a rolling stand (reverse rolling mill) and a coil tail end-side tension reel. FIG. 2 is a schematic view showing a structure of the cold-rolling facility for the steel sheet coil according to the embodiment of the present invention.

In the cold-rolling facility according to the present embodiment, a rolling stand (reverse rolling mill) 1 is disposed at the center. Further, across the rolling stand 1, a coil leading end-side tension reel 2 is disposed on one side, and a coil tail end-side tension reel 3 and a pay-off reel 4 are disposed on the other side. Note that there is a deviation between a pass line used at the time of unwinding from the pay-off reel 4 and a pass line of a steel sheet 7 between the coil tail end-side tension reel 3 and the rolling stand 1, though not clearly illustrated in FIG. 2.

Figure 2:
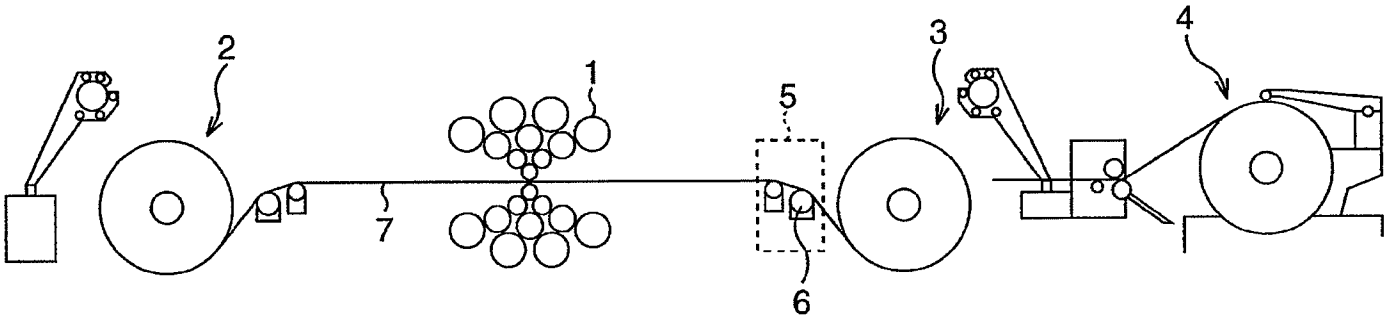
FIG. 2 is a schematic view showing a structure of a cold-rolling facility for a steel sheet coil according to an embodiment of the present invention.

Further, as illustrated in FIG. 2, in a region 5 between the rolling stand 1 and the coil tail end-side tension reel 3, a heater is disposed so as to be close to a pass line where the steel sheet 7 is heated. Further, in the region 5, a deflector roll 6 on a coil tail end side is also disposed. The heater is desirably disposed as close as possible to the tension reel 3 in order to prevent the heat from being deprived of during a period from the heating to the winding. Further, the coil tail end portion is desirably heated at least while it moves toward the tension reel 3. Therefore, the heater is desirably disposed between the tension reel 3 and the deflector roll 6.

If disposed between the tension reel 3 and the deflector roll 6, the heater is kept clear of the pass line where the steel sheet coil is unwound from the pay-off reel 4. Since various devices are densely disposed in the pass line where the steel sheet coil is unwound from the pay-off reel 4, it is difficult to reserve space for disposing the heater therein. Therefore, if the heater is disposed so as to be kept clear of the pass line where the steel sheet coil is unwound from the pay-off reel, it is greatly advantageous.

Note that, desirably, the heater is disposed between the tension reel 3 and the deflector roll 6 in a manner that at the time of the heating, the heater is located near a line where the steel sheet 7 is wound around the tension reel 3 to be capable of heating the tail end portion of the steel sheet 7, and after the heating, the heater is capable of being evacuated from an area for the winding so as not to obstruct the winding of the steel sheet 7.

Here, a concrete example of the heater will be described. FIG. 3 is a schematic view showing an example of the heater.

Figure 3:
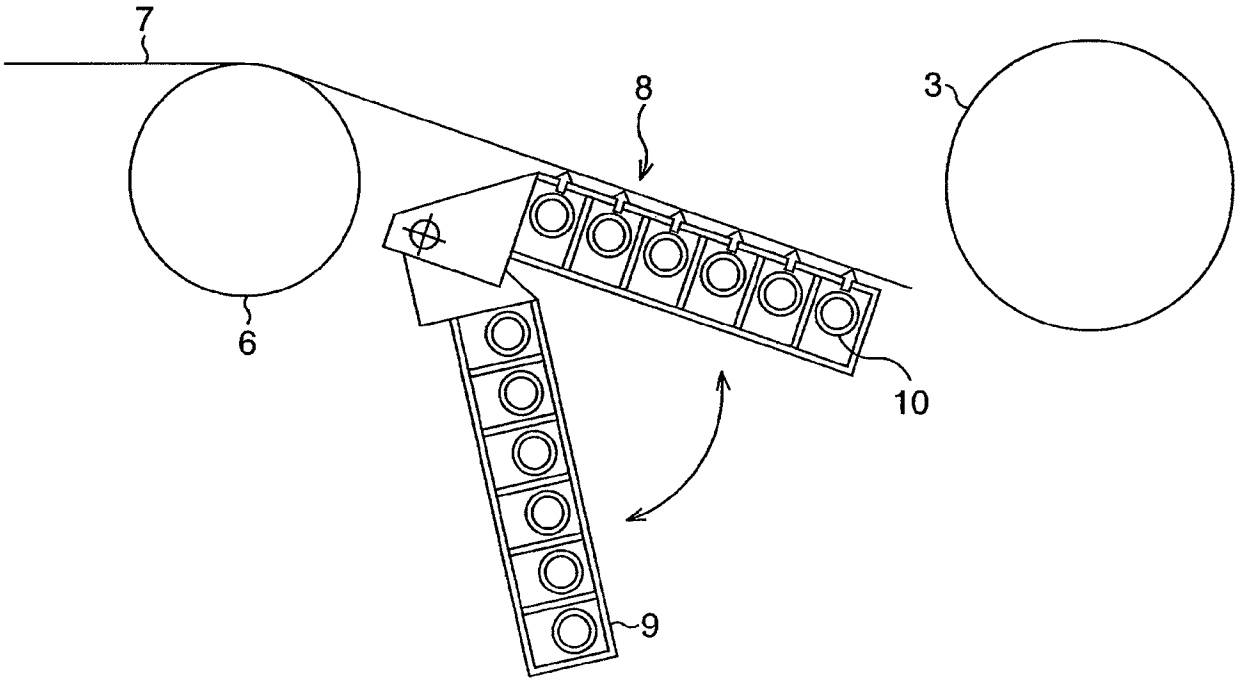
FIG. 3 is a schematic view showing an example of a heater.
Figure 4A:
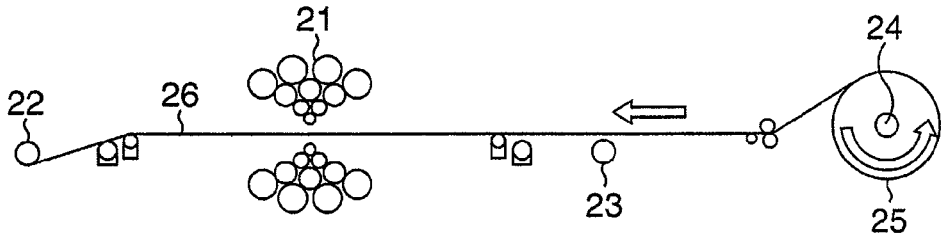
FIG. 4A is a view showing a cold-rolling method using a single-stand reverse rolling mill.
Figure 4B:
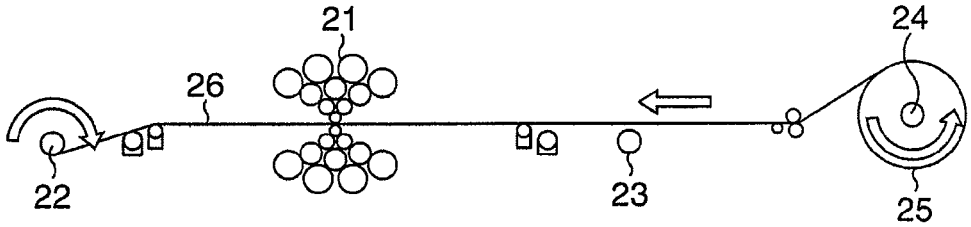
FIG. 4B is a view showing the cold-rolling method continued from FIG. 4A.
Figure 4C:
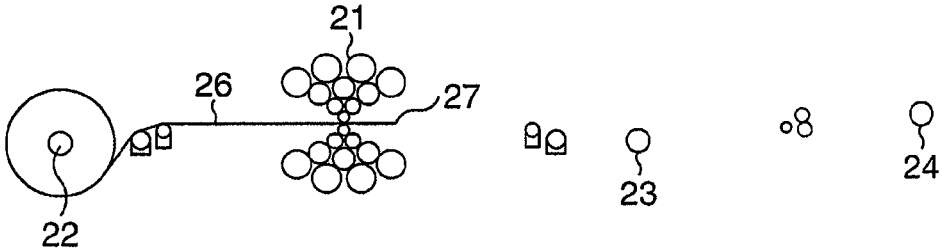
FIG. 4C is a view showing the cold-rolling method continued from FIG. 4B.
Figure 4D:
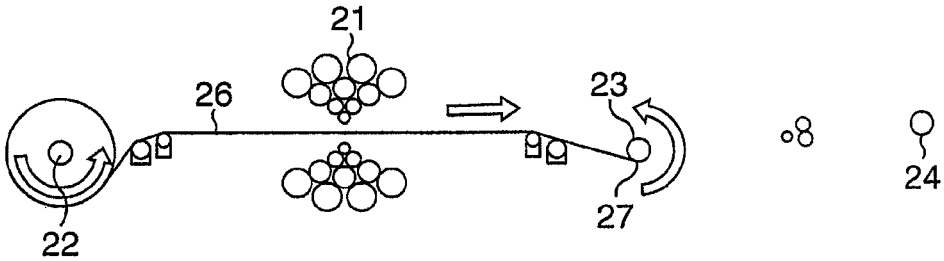
FIG. 4D is a view showing the cold-rolling method continued from FIG. 4C.
Figure 4E:
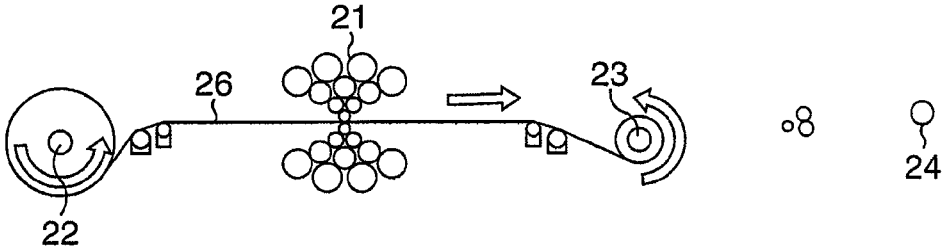
FIG. 4E is a view showing the cold-rolling method continued from FIG. 4D.
Figure 5:
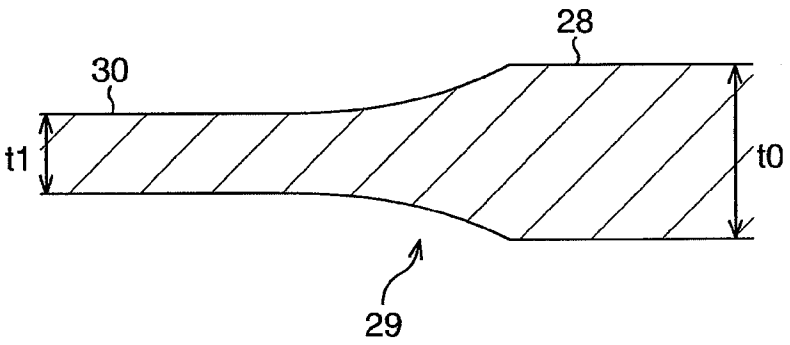
FIG. 5 is a cross-sectional view showing a coil tail end portion after first-pass rolling.

As illustrated in FIG. 3, between the deflector roll 6 and the tension reel 3, a coil end guide 9 guiding a coil tail end portion 8 to the tension reel 3 is provided. The heater is provided in the coil end guide 9. Specifically, a plurality of header units 10 in a tubular shape each having a plurality of steam jetting nozzles is fixed to the coil end guide 9.

In the reverse rolling, when the coil tail end portion 8 is wound around the tension reel 3, the coil end guide 9 is positioned in the pass line to guide the coil tail end portion 8. At this time, following the coil end guide 9, the header units 10 come close to the coil tail end portion 8. Then, the heater jets high-temperature steam from the nozzles of the header units 10 to the steel sheet 7 as illustrated by the arrows in FIG. 3, thereby heating the coil tail end portion 8 from a lower surface side by utilizing latent heat of devolatilization which is generated when gas changes to liquid. As a result, it is possible to quickly heat the coil tail end portion 8 nearly to a 100° C. temperature, so that the lower surface of the coil tail end portion 8 can be heated while being wound around the tension reel 3. Therefore, it is possible to wind the steel sheet 7 around the tension reel 3 without causing any fracture in the unrolled portion and the roll bite portion.

Further, according to the above structure, between the tension reel 3 and the deflector roll 6, the heater approaches the line where the steel sheet 7 is wound around the tension reel 3, to be capable of heating the coil tail end portion 8. Further, after the heating, the heater can be evacuated from the area for winding so as not to obstruct the winding of the steel sheet 7.

Incidentally, as the heater, an electric heater such as an ohmic heater and an induction heater is usable. The electric heater is preferably disposed so that it can move to a heating position and an evacuation position from above so as to heat the coil tail end portion 8 from the front surface side.

Next, the result of an experiment actually conducted by the inventors of the present application will be described.

In this experiment, by using the heater including the header units jetting steam, the induction heater, and the ohmic heater, which are described above, tail end portions of hot-rolled coils for grain-oriented electromagnetic steel sheets whose Si contents were 3.25 mass % and 3.5 mass % were heated to various temperatures and the cold-rolling was performed.

TABLE 1

| | | Si (mass %) | heating method | heating temperature (° C.) | fracture | note |
|---|---|---|---|---|---|---|
| invention example | A1 | 3.25 | steam | 50 | none | |
| invention example | A2 | | steam | 90 | none | |
| invention example | A3 | | induction heating | 150 | none | |
| invention example | A4 | | induction heating | 300 | none | |
| invention example | A5 | | ohmic heating | 350 | none | |
| invention example | A6 | 3.5 | steam | 50 | none | |
| invention example | A7 | | steam | 90 | none | |
| invention example | AS | | induction heating | 150 | none | |
| invention example | A9 | | induction heating | 300 | none | |
| invention example | A10 | | ohmic heating | 350 | none | |
| comparative example | B1 | 3.25 | — | 20 | fracture | |
| comparative example | B2 | 3.5 | — | 20 | x | not windable |

As illustrated in Table 1, in all the cases where the tail end portion of the coil was heated, the cold-rolling could be performed without any fracture. In the cases where the tail end portion of the coil was not heated, fracture occurred in the tail end portion or the winding to the reel was not possible.

The embodiments described above are examples of the present invention, and the present invention is not limited to these embodiments and can be embodied in other forms.

INDUSTRIAL APPLICABILITY

Conventionally, it is difficult to ensure a steel sheet temperature at which a sufficient effect of alleviating brittleness in a coil tail end portion is obtained, or an attempt to ensure a sufficiently high steel sheet temperature results in an increase in facility cost and a difficulty in maintenance of the facility. On the other hand, according to the present invention, these problems are solved and it is possible to ensure a steel sheet temperature at which sheet fracture does not easily occur. As a result, it is possible to improve productivity of the steel sheet.

What is claimed is:

1. A method of cold-rolling a steel sheet coil, comprising:

drawing out a leading end of the steel sheet coil from a pay-off reel;

after the drawing, winding the leading end around a first tension reel via a single-stand reverse rolling mill;

after the winding, rolling the steel sheet coil in a first pass with using the reverse rolling mill and giving a tension between the pay-off reel and the first tension reel;

stopping the rolling in the first pass when a tail end portion of the steel sheet coil is at a position between the reverse rolling mill and a second tension reel;

after the stopping, heating the tail end portion to a temperature within a range of not lower than 50° C. nor higher than 350° C. with a heater disposed between the reverse rolling mill and the second tension reel, and winding the tail end portion around the second tension reel; and after the heating, rolling the steel sheet coil in second and subsequent passes with using the reverse rolling mill and giving a tension between the first tension reel and the second tension reel.

2. The method of cold-rolling a steel sheet coil according to claim 1, wherein the tail end portion is heated with the heater while approaching the second tension reel.

3. The method of cold-rolling a steel sheet coil according to claim 1, wherein the tail end portion includes an unrolled portion left unrolled after the rolling in the first pass and a roll bite portion adjacent to the unrolled portion.

4. The method of cold-rolling a steel sheet coil according to claim 2, wherein the tail end portion includes an unrolled portion left unrolled after the rolling in the first pass and a roll bite portion adjacent to the unrolled portion.

5. The method of cold-rolling a steel sheet coil according to claim 1, wherein the steel sheet coil is a hot-rolled coil for a grain-oriented electromagnetic steel sheet containing 3 mass % Si or more, and the tail end portion is heated with the heater to a temperature range within a 50° C. to 150° C. range.

6. The method of cold-rolling a steel sheet coil according to claim 2, wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

7. The method of cold-rolling a steel sheet coil according to claim 3, wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

8. The method of cold-rolling a steel sheet coil according to claim 4, wherein:

the steel sheet coil is a hot-rolled coil for a grain-oriented electromagnetic steel sheet containing 3 mass % Si or more, and the tail end portion is heated with the heater to a temperature range within a 50° C. to 150° C. range.

* * * * *